US007027360B2

(12) United States Patent
Kitahara et al.

(10) Patent No.: US 7,027,360 B2
(45) Date of Patent: Apr. 11, 2006

(54) ELECTRONIC TIMEPIECE WITH A DATE DISPLAY FUNCTION

(75) Inventors: Joji Kitahara, Shiojiri (JP); Jun Matsuzaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 229 days.

(21) Appl. No.: 10/374,645

(22) Filed: Feb. 26, 2003

(65) Prior Publication Data

US 2003/0198139 A1 Oct. 23, 2003

(30) Foreign Application Priority Data

Feb. 28, 2002 (JP) ..... 2002-054762

(51) Int. Cl.
*G04B 19/24* (2006.01)

(52) U.S. Cl. ..... 368/28; 368/35; 368/37; 368/31; 368/32; 368/34

(58) Field of Classification Search ..... 368/28, 368/35, 37, 31, 32, 34
See application file for complete search history.

(56) References Cited

U.S. PATENT DOCUMENTS

| | | | | |
|---|---|---|---|---|
| 2,764,828 A | | 10/1956 | Wolaver | |
| 3,477,222 A | | 11/1969 | Chi et al. | |
| 4,276,628 A | * | 6/1981 | Nomura | 368/85 |
| 4,541,725 A | | 9/1985 | Baumgartner | |
| 4,972,393 A | * | 11/1990 | Sase et al. | 368/28 |
| 5,270,993 A | | 12/1993 | Besson et al. | |
| 5,305,289 A | | 4/1994 | Besson et al. | |
| 6,046,964 A | | 4/2000 | Higuchi et al. | |
| 6,278,661 B1 | | 8/2001 | Higuchi et al. | |
| 6,385,136 B1 | | 5/2002 | Higuchi et al. | |
| 6,735,151 B1 | * | 5/2004 | Triponez | 368/28 |

FOREIGN PATENT DOCUMENTS

| | | | |
|---|---|---|---|
| CH | 253 518 | | 3/1948 |
| CH | 688671 | * | 1/1998 |
| EP | 0 383 541 | | 8/1990 |
| GB | 1 602 034 | | 11/1981 |
| JP | 54-166878 | | 5/1978 |
| JP | 54-114269 | | 9/1979 |
| JP | 55-112586 | | 8/1980 |
| JP | 55-138677 | | 10/1980 |
| JP | 58-22713 | | 5/1983 |

* cited by examiner

*Primary Examiner*—Andrew H. Hirshfeld
*Assistant Examiner*—Andrea H. Evans
(74) *Attorney, Agent, or Firm*—Rosalio Haro

(57) ABSTRACT

An electronic timepiece with date display function reduces power consumption in conjunction with the user adjusting the date, and makes it easier for the user to set the date. A displayed date detection unit H has a day detector H1 for detecting the displayed day, a month detector H2 for detecting the displayed month, and a year detector H3 for detecting the displayed year. A control unit A controls a calendar mechanism drive unit F according to the date detected by detectors H1 to H3.

9 Claims, 13 Drawing Sheets

| | 29 | 30 | 31 | 1-28 |
|---|---|---|---|---|
| NORMALLY-CLOSED CONTACT Sd1 | OPEN | OPEN | CLOSED | CLOSED |
| NORMALLY-CLOSED CONTACT Sd2 | OPEN | CLOSED | OPEN | CLOSED |

| | 31 DAY MONTHS | 30 DAY MONTHS | FEBRUARY |
|---|---|---|---|
| NORMALLY-CLOSED CONTACT Sm1 | CLOSED | CLOSED | OPEN |
| NORMALLY-CLOSED CONTACT Sm2 | CLOSED | OPEN | CLOSED |

FIG. 9

| | 0 (LEAP YEAR) | I - III |
|---|---|---|
| NORMALLY-CLOSED CONTACT Sy | OPEN | CLOSED |

FIG. 10

ELECTRONIC TIMEPIECE WITH A DATE DISPLAY FUNCTION

BACKGROUND OF THE INVENTION

1. Field of the Invention

The present invention relates to a timepiece having a date display function.

2. Description of the Related Art

A common date display mechanism used in wristwatches and other types of timepieces has a ring-shaped display panel called a day wheel. The numbers 1 to 31 are evenly spaced around the circumference of the day wheel, and the day wheel is rotationally driven linked to the gear train for rotationally driving the hour hand for displaying the hour. For example, when the hour hand is turned the equivalent of 24 hours by the gear train, the day wheel turns a distance equal to one day (that is, a 360/31 degree angle of rotation), and a number corresponding to the date is displayed in the date window provided in the dial of the wristwatch.

A problem with this simple date display mechanism is that at the end of the month in months shorter than 31 days in the solar calendar (that is the short months of February, April, June, September, and November), a non-existent date that is not actually on the calendar is displayed. Japanese Patent Laid-Open Publication (kokai) H5-142362 teaches a mechanical timepiece with a so-called perpetual calendar function achieved using a combination of gears. Between the gear train and day wheel this mechanical timepiece has multiple gears combined to drive the day wheel according to the date in each month of a four year period including a leap year so that non-existent dates are not displayed. A problem with this mechanical timepiece is that many more gears than typical are required, resulting in a complicated mechanism and high production costs.

To solve this problem attention has recently focused on electronic timepieces having a date display mechanism consisting of an integrated circuit (IC) device as a controller, a storage device for storing calendar information denoting the year, month, and day, an actuator controlled by the IC device, and a day wheel rotationally driven by the actuator. The IC device has an evaluation function for determining if the date indicated by the calendar information is a non-existent date. By displaying the date based on the result passed by this evaluation function, non-existent dates are not left displayed in the date window, and the correct calendar date is thus displayed.

A problem with such electronic timepieces is that the user must adjust the calendar information to the actual date if the date displayed in the date window becomes different from the actual date as a result of replacing the battery. More specifically, when the battery of an electronic timepiece powered by a primary cell is replaced at a jeweler or watch dealer, the jeweler, for example, adjusts the calendar information. With an electronic timepiece powered by a secondary cell, the user adjusts the calendar information after charging the battery. It is assumed below that primarily the user adjusts the calendar information.

A problem with this electronic timepiece is that if the date displayed in the date window is offset much from the actual date, the actuator must rotationally drive the day wheel a corresponding distance to adjust the date, and this consumes much power. If much power is consumed to adjust the date in an electronic timepiece powered by a secondary cell in particular, the resulting voltage drop could cause the electronic timepiece itself to stop.

A further problem is that it takes a while to finish adjusting the date if the actuator must rotationally drive the day wheel very far.

A yet further problem with this electronic timepiece of the prior art is that adjusting the calendar information stored in the IC is difficult and complex. For example, in order to adjust the calendar information in this prior art electronic timepiece the user must first manipulate the crown or other operator to set the date displayed in the date window to a specific reference date (such as January 1 of a leap year), then apply a calendar information initialization command to the IC in order to set the stored calendar information to the displayed date (that is, reset it to a reference position). The user then sets the current date as the displayed date.

In a conventional electronic timepiece having a display window for displaying only the day, the year and month are generally displayed by the movement of the hands in a manner similar to how the hour hand and minute hand are displayed.

When the displayed date and the actual date are offset in a conventional electronic timepiece as described above, the user must perform an adjustment sequence such as described above, and this operation can be extremely complicated. Furthermore, adjusting the calendar information is particularly difficult if the user forgets this adjustment procedure.

OBJECTS OF THE INVENTION

The present invention is therefore directed to solving these problems, and an object of this invention is to provide an electronic timepiece with a date display function whereby the user can more easily adjust the date, and whereby power consumption, when the user adjusts the date, is reduced.

SUMMARY OF THE INVENTION

To achieve this object an electronic timepiece with a date display function according to the present invention has a drive means for driving an actuator; a date display means that is driven by the actuator and is disposed to enable being driven by manipulation of an operator for displaying a calendar date; a date detecting means for detecting the date displayed by the date display means; and a control means for determining if the detected date is a non-existent date on the calendar, and controlling the drive means so an existing date is displayed by the date display means if the displayed date is a non-existent date.

The date displayed by the date display means of this electronic timepiece with date display function according to the present invention can be easily adjusted by the user manipulating the operator. After the user adjusts the date, the date detecting means detects the date displayed by the date display means, and the control means determines if the detected date is a valid date that exists on the calendar. If the detected date is a non-existent date, the control means controls the drive means to display an existing date, thereby achieving a perpetual calendar function.

Correcting the calendar information, including setting the date to a specified reference date, as is required with a prior art electronic timepiece is therefore unnecessary with the present invention, and a perpetual calendar function can be achieved with the user simply adjusting the date displayed by the date display means. In other words, the present invention makes it easier and faster to adjust the date.

The need for an actuator to drive the date display means when the user adjusts the date is also eliminated in the present invention, and power consumption is therefore reduced. It is also not necessary to provide counters for storing calendar information related to the year, month, and day in an IC device. The design of the IC circuitry is thus simplified and the circuit scale of the IC can thereby be reduced. The device can thus be downsized and manufacturing costs can be reduced.

The date display means of this electronic timepiece with date display function preferably has a day display means for displaying a calendar day, and the date detecting means detects the day displayed by the date display means. The electronic timepiece also has a month counter circuit for counting calendar months according to the detected day and outputting the counter value, and a year counter circuit for counting calendar years according to the count from the month counter circuit, and outputting the counter value. The control means determines from the detected day and the counts from the month counter circuit and year counter circuit if the day displayed by the day display means is a non-existent date on the calendar. The IC device used in the present invention thus only has counter circuits for counting the month and year, and IC circuit design is therefore simpler than prior art IC devices having counters for counting the day, month, and year.

An electronic timepiece with date display function according to a further aspect of the present invention has a drive means for driving an actuator; a day display means that is driven by the actuator and is disposed to enable being driven by manipulation of an operator for displaying a calendar day; a month indicating means for indicating a calendar month as driven by the day display means; a date detecting means for detecting the day displayed by the day display means and the month indicated by the month indicating means; and a control means for determining from the detected day and month if the day displayed by the day display means is a non-existent date on the calendar, and if the displayed date is a non-existent date controlling the drive means to drive the day display means until an existing date is displayed.

The date detecting means of this electronic timepiece with date display function detects the day displayed by the day display means and the month indicated by the month indicating means. Based on the result passed from the date detecting means, the control means determines if the day displayed by the day display means is a non-existent date on the calendar, and if the displayed date is a non-existent date controls the drive means to drive the day display means until an existing date is displayed.

The user can thus manipulate the operator of this electronic timepiece with date display function to set the day displayed by the day display means and the month indicated by the month indicating means denote an actual date.

Furthermore, instead of storing calendar information as in a conventional electronic timepiece, the control means can get the day displayed by the day display means and the month indicated by the month indicating means from the date detecting means. The user therefore does not need to correct the calendar information stored in the IC device as in a conventional electronic timepiece, and can therefore quite easily and quickly adjust the date without using a complicated process.

Furthermore, if the day displayed by the day display means differs from the current actual date, the user can change the day displayed by the day display means by manipulating the operator. Driving the day display means by means of an actuator is therefore unnecessary, and power consumption can be significantly reduced compared with the prior art.

The electronic timepiece of our invention further preferably has a year indicating means for indicating a calendar year as driven by the day display means. The date detecting means detects the year indicated by the year indicating means. The control means then determines from the detected day, month, and year if the day displayed by the day display means is a non-existent date on the calendar.

Further preferably, the timepiece is configured to display the month indicated by the month indicating means, and yet further preferably to also display the year indicated by the year indicating means.

The year denoted by the year indicating means could be an absolute year value such as the year on the Gregorian calendar, or a relative year value such as the number of years since the last leap year. With this configuration the day hand and time hands (hour, minute, and second hands) are not also used to indicate the month as in a prior art timepiece. Because a month display means and year display means are provided separately to the day display means, the user can read the date easily without performing any special operation, and can also easily adjust the date.

Another electronic timepiece with date display function according to the present invention has a drive means for driving an actuator; a day display means that is driven by the actuator and is disposed to enable being driven by manipulation of an operator for displaying a calendar day; a year-month indicating means for indicating a number of years since a previous leap year and a calendar month as driven by the day display means; a date detecting means for detecting the day displayed by the day display means, and the number of years since a previous leap year and calendar month indicated by the year-month indicating means; and a control means for determining from the detected day, years since a previous leap year, and month if the day displayed by the day display means is a non-existent date on the calendar, and if the displayed date is a non-existent date controlling the drive means to drive the day display means until an existing date is displayed.

In any of the electronic timepiece with date display function described above the day display means preferably alternatively has a first order display wheel and a second order display wheel. The first order display wheel is a flat member having positioned on a surface thereof the numerals or symbols denoting the numerals 0 to 9 for displaying the one's digit of a calendar day as driven. This first order display wheel is driven by the actuator driven by the drive means and is also disposed to enable being driven by manipulation of the operator. The second order display wheel is likewise a flat member having positioned on a surface thereof the numerals or symbols denoting the numerals 0 to 3 for displaying the ten's digit of the calendar day according to first order display wheel drive.

The electronic timepiece with date display function of this invention could be a wristwatch, pocket watch, or other type of portable watch, or a wall clock, mantel clock, or other type of stationary clock.

This electronic timepiece could also be a clock that receives a radio signal indicating a standard time and electronically adjusts the time accordingly.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 9 is a table showing the correlation between the displayed month and the open/closed states of normally-closed contacts disposed in the month detection unit to detect the month.

FIG. 10 is a table showing the correlation between the displayed year and the open/closed states of normally-closed contacts disposed in the year detection unit to detect the year.

DESCRIPTION OF THE PREFERRED EMBODIMENTS

Preferred embodiments of the present invention are described below with reference to the accompanying figures. The present invention is described applied to a wristwatch by way of example. The date in each of the following embodiments is based on the solar calendar.

Figure 1:
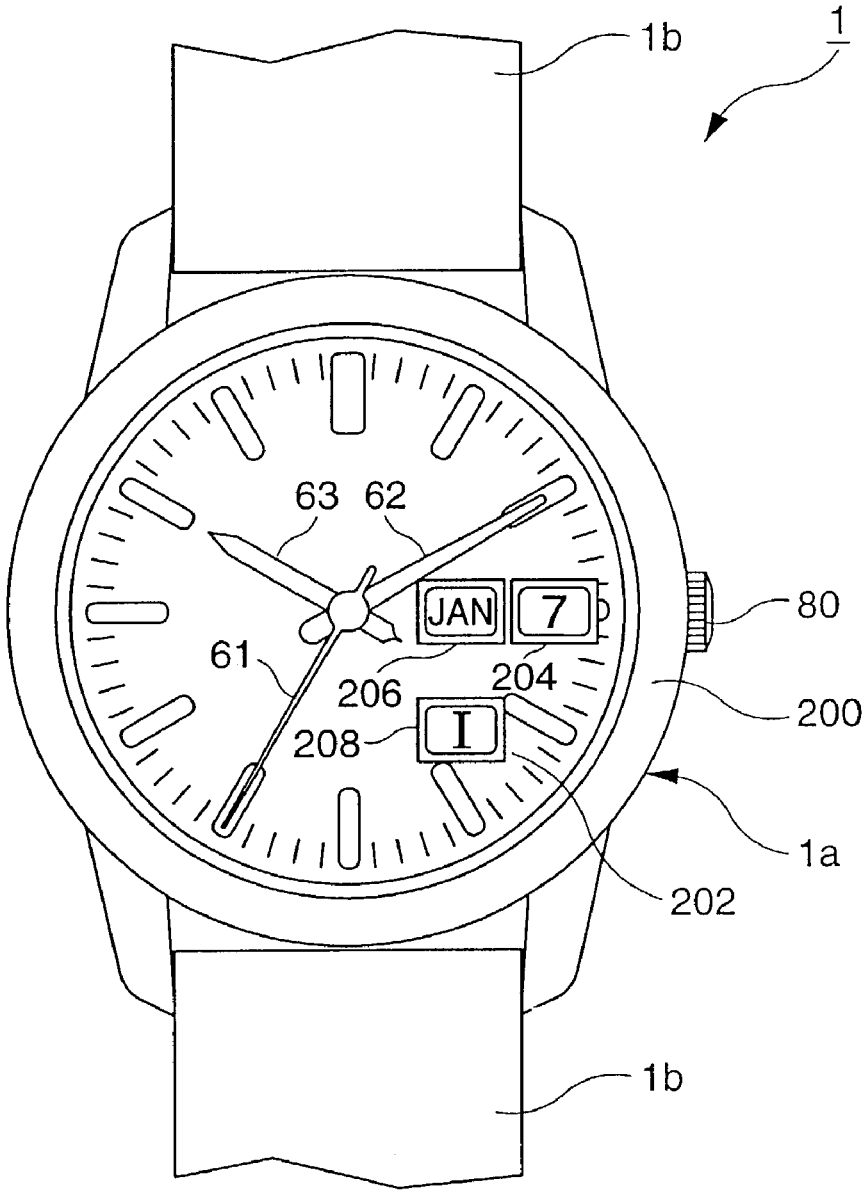
FIG. 1 shows the typical appearance of a wristwatch according to a preferred embodiment of the present invention.

FIG. 1 shows the typical appearance of a wristwatch according to a preferred embodiment of the present invention. As shown in FIG. 1 this wristwatch 1 has a watch body 1*a*, and a band 1*b* attached to the watch body 1*a*. The watch body 1*a* has a case 200, a round dial 202 disposed in the case 200, and a crown 80 protruding from the case 200. Three display hands, that is, a seconds hand 61, a minutes (long) hand 62, and an hours (short) hand 63, are disposed above the dial 202. Symbols denoting the time are located at equal intervals around the circumference of the dial 202, and the current time is displayed by the numerals or symbols (these symbols could be letters) pointed to by the display hands.

A substantially rectangular day window 204, month window 206, and year window 208 are opened through the dial 202. A single number from 1 to 31 denoting the calendar day is displayed in day window 204. Letters denoting the calendar month from JAN (January) to DEC (December) are displayed in month window 206. In this embodiment a Arabic numeral 0 or Roman numerals from I to III are displayed in the year window 208 to denote the number of years since the last leap year. More specifically, if the current calendar year is a leap year, then Arabic numeral "0" is displayed in year window 208, but if the current year is the year immediately following a leap year, for example, then Roman numeral "I" is displayed in the year window 208. By thus displaying a number in year window 208 indicating the number of years since the last leap year, the user can determine the current calendar year.

Figure 2:
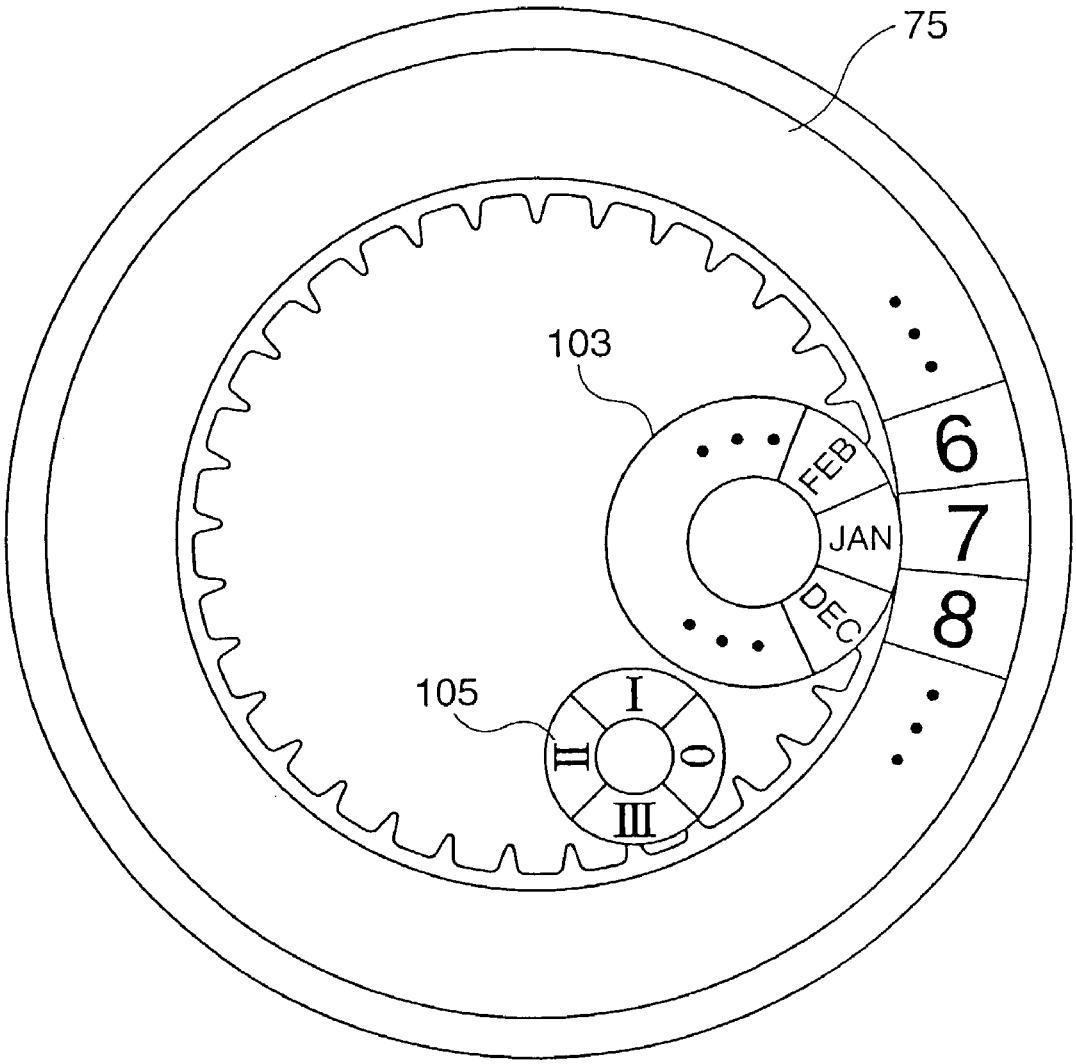
FIG. 2 is a plan view showing part of the date display mechanism.

FIG. 2 is a plan view showing part of the date display mechanism assembled inside the case 200 below the dial 202. As shown in FIG. 2 the date display mechanism has a ring-shaped day wheel 75, a round month wheel 103, and a year wheel 105.

The numbers "1" to "31" are located at even intervals around the day wheel 75, and letters denoting the twelve calendar months are located at even intervals around the month wheel 103. The Arabic numeral 0 and Roman numerals I to III are located at even intervals around the year wheel 105. The day wheel 75, month wheel 103, and year wheel 105 are mutually linked so as to turn in conjunction with each other.

Figure 3:
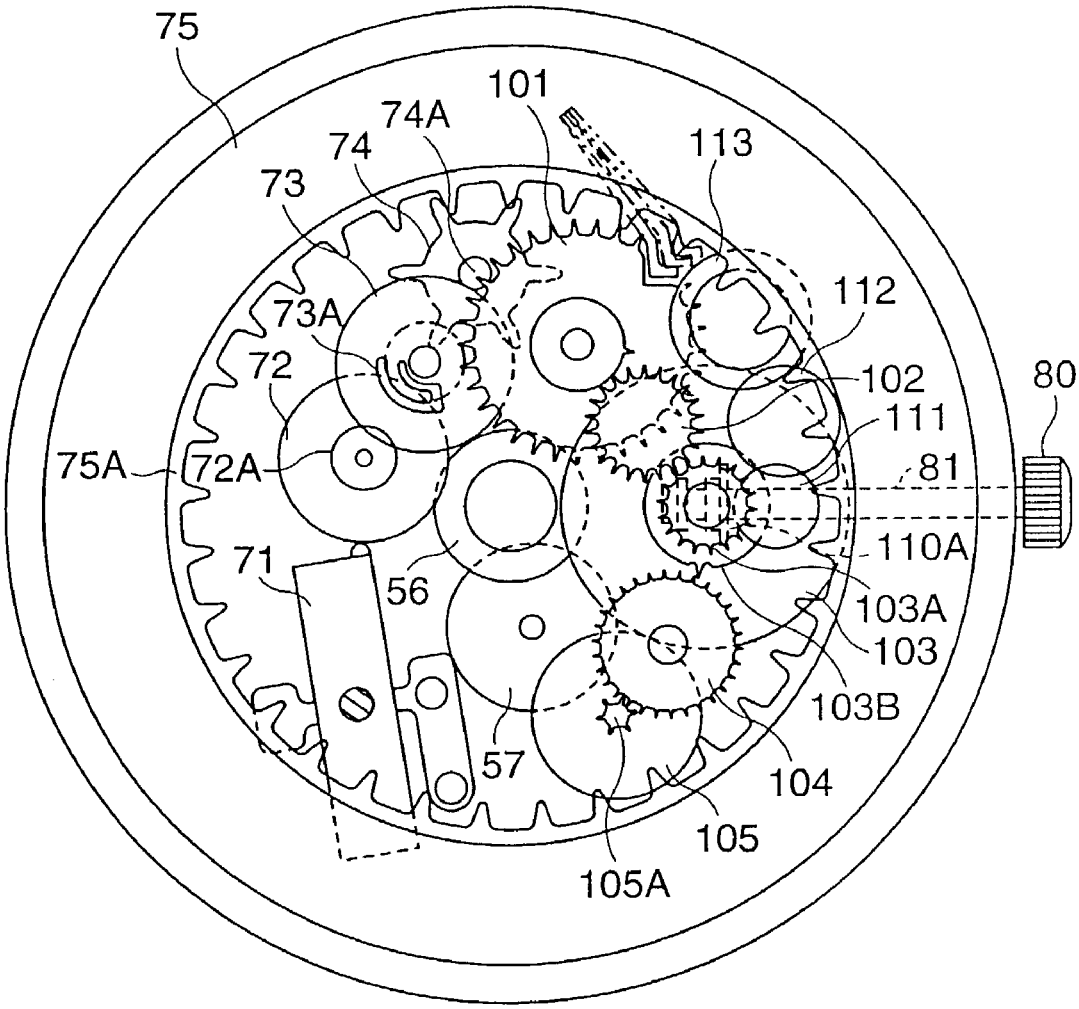
FIG. 3 shows the mechanical configuration of the date display mechanism.

FIG. 3 shows the mechanical configuration of the date display mechanism. As shown in the figure, the date display mechanism has a piezoelectric actuator 71 for rotationally driving day wheel 75. This piezoelectric actuator 71 has a piezoelectric vibrator and is controlled by the drive circuit described below.

Figure 4:
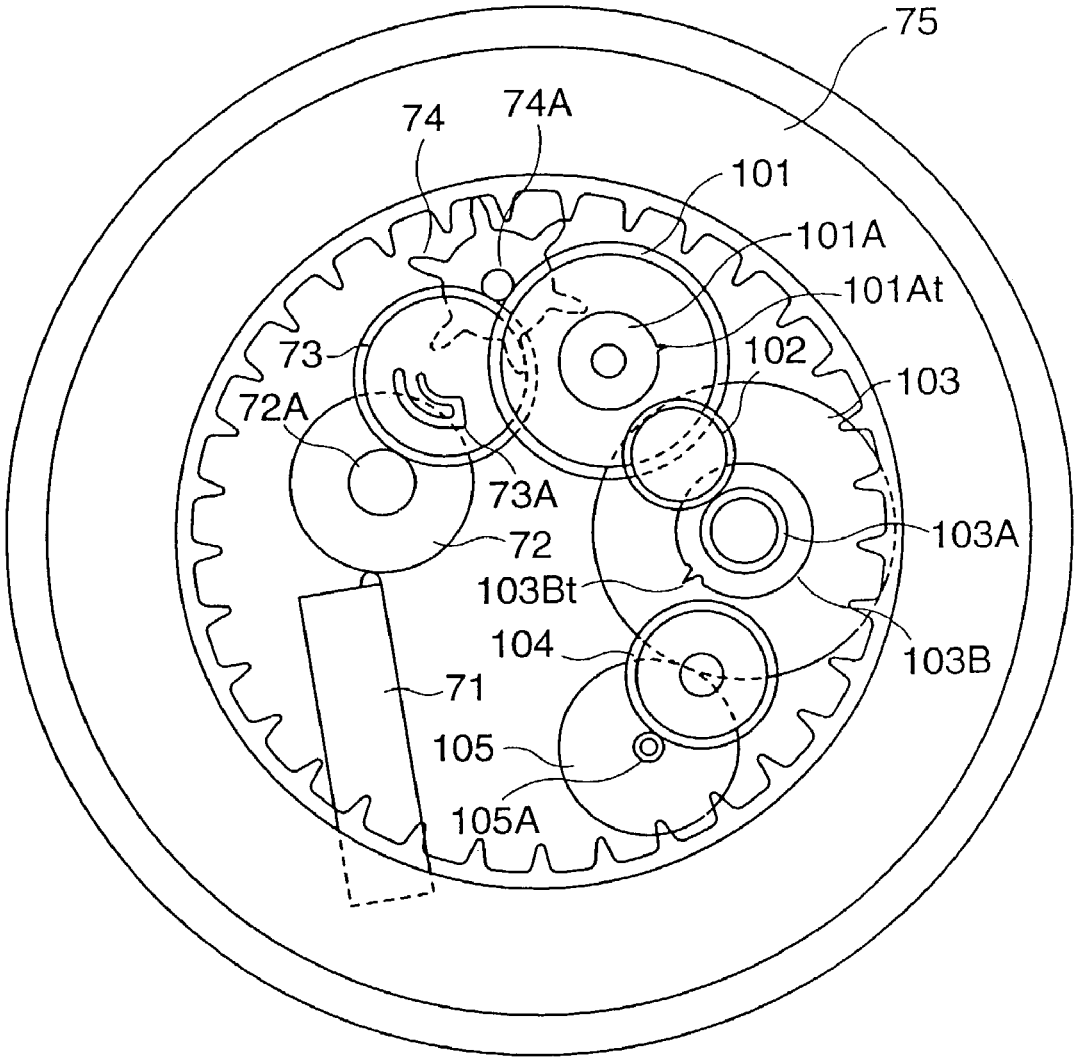
FIG. 4 shows the parts of the date display mechanism that are driven by the vibration of the piezoelectric actuator.

FIG. 4 shows the parts of the date display mechanism shown in FIG. 3 that are linked to the vibrations of the piezoelectric actuator 71. As shown in FIG. 4 circular rotor 72 is rotatably disposed so that it can rotate in contact with one end of the piezoelectric actuator 71. The rotor 72 turns clockwise when the outside edge of the rotor 72 is struck by the vibration of piezoelectric actuator 71, and rotation of the rotor 72 is transferred to date-driving-intermediate wheel 73, controlled wheel 101, and date-driving wheel 74.

More specifically, a circular rotor pinion 72A that turns in conjunction with rotor 72 rotation is disposed coaxially to on the top surface of rotor 72, and this rotor pinion 72A meshes with date-driving-intermediate wheel 73, which is a disc-shaped gear. Feed claw 73A is disposed rising above the top surface of date-driving-intermediate wheel 73. When the date-driving-intermediate wheel 73 turns counterclockwise linked to the clockwise rotation of rotor pinion 72A, feed claw 73A engages teeth disposed to the circumference of controlled wheel 101, and controlled wheel 101 thus turns clockwise.

The controlled wheel 101 meshes with disc-shaped date-driving pinion 74A disposed to the top of date-driving wheel 74. Date-driving wheel 74, which is the bottom of date-driving pinion 74A and is disposed concentrically to date-driving pinion 74A, engages teeth disposed to the inside circumference side of day wheel 75. When controlled wheel 101 turns clockwise in this configuration, date-driving pinion 74A and date-driving wheel 74 turn counterclockwise, and day wheel 75 turns counterclockwise.

A circular, controlled wheel pinion 101A is disposed on the top of controlled wheel 101 so that it turns coaxially to the controlled wheel 101. A disc-shaped month intermediate wheel 102 (gear) is also disposed adjacent to the controlled wheel pinion 101A on top of controlled wheel 101. A month-driving tooth 101At is formed on the outside of controlled wheel pinion 101A. When controlled wheel pinion 101A turns clockwise in conjunction with rotation of controlled wheel 101, month-driving tooth 101At engages teeth on month intermediate wheel 102, and month intermediate wheel 102 turns counterclockwise.

The month intermediate wheel 102 meshes with disc-shaped month wheel pinion 103A, which is a gear. The disc-shaped month wheel 103 is rotatably disposed coaxially to on the bottom of month wheel pinion 103A. With this configuration when month intermediate wheel 102 turns counterclockwise linked to rotation of controlled wheel pinion 101A, month wheel pinion 103A and month wheel 103 turn clockwise.

It should be noted that the number of teeth on controlled wheel 101, month intermediate wheel 102, and month wheel pinion 103A is set so that each time controlled wheel 101 turns day wheel 75 by 360 degrees (that is, each time day wheel 75 turns the distance of 31 days), month wheel 103 turns 360/12 degrees (that is, the month advances one month).

As also shown in the figure a disc-shaped month wheel 103B is disposed between month wheel 103 and month wheel pinion 103A so that it turns coaxially to month wheel 103, and a disc-shaped year intermediate wheel 104 (a gear) is disposed adjacent to month wheel 103B. A year-driving tooth 103Bt is formed on the outside surface of month wheel 103B. When month wheel 103B turns clockwise in conjunction with rotation of month wheel 103, year-driving tooth 103Bt engages the teeth on year intermediate wheel 104 and year intermediate wheel 104 thus turns counterclockwise.

The year intermediate wheel 104 meshes with the disc-shaped year wheel 105A (a gear). The disc-shaped year wheel 105 is rotatably disposed to on the bottom of year wheel 105A coaxially to the year wheel 105A.

When the year intermediate wheel 104 turns counterclockwise linked to rotation of month wheel 103 in this configuration, year wheel 105 turns clockwise together with year wheel 105A.

It should be noted that the number of teeth on month wheel 103B, year intermediate wheel 104, and year wheel 105A is set so that each time month wheel 103 turns 360 degrees (that is, the month advances twelve months), the year wheel 105 turns 360/4 degrees (that is, the year advances one year).

Figure 5:
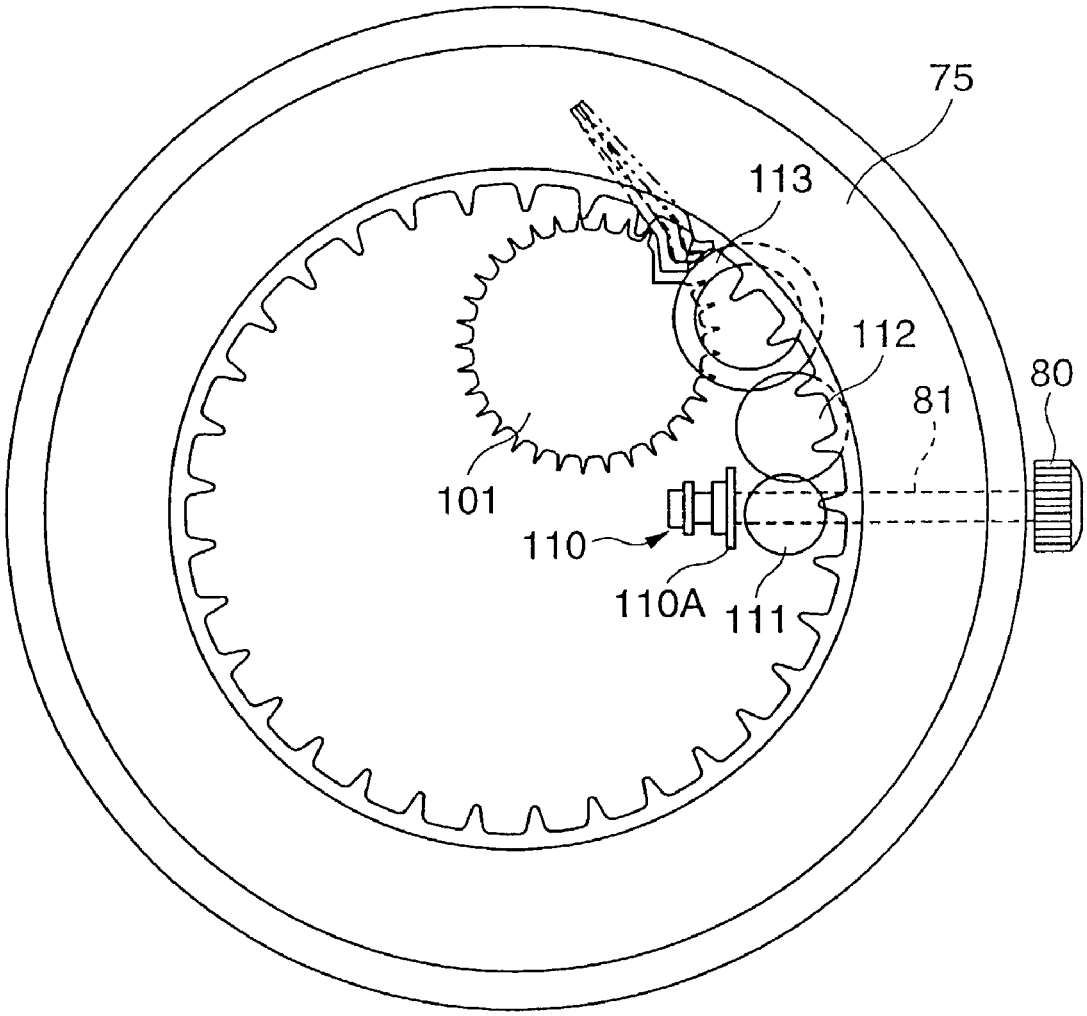
FIG. 5 shows the parts of the date display mechanism that turn in conjunction with rotation of the crown.

As also shown in FIG. 1 and FIG. 3, a crown 80 is rotatably disposed at the side of case 200 of wristwatch 1. This crown 80 is an operator manipulated by the user. When the user turns crown 80 the rotation is transferred from a stem to rotationally drive day wheel 75, month wheel 103, and year wheel 105. FIG. 5 shows the parts of the date display mechanism shown in FIG. 3 that turn linked to rotation of crown 80.

As shown in FIG. 5 a rod-like stem 81 projects to the left side of the crown 80 as seen in the figure, and a clutch wheel 110 is disposed at the left distal end of the stem 81. A disc-shaped first date-adjusting transfer wheel 110A (a gear) is disposed to the right end side of the clutch wheel 110. This first date-adjusting transfer wheel 110A is coaxial to the long axis of stem 81 and turns in conjunction with stem 81. A second date-adjusting transfer wheel 111 (a gear) is disposed above stem 81 rotatable in the same plane as the drawing at a position separated to the right side in the drawing from first date-adjusting transfer wheel 110A.

The crown 80 can be pulled out in multiple steps to the right side in the figure. When the crown 80 is pulled out by the user to a first step, first date-adjusting transfer wheel 110A meshes with second date-adjusting transfer wheel 111. This second date-adjusting transfer wheel 111 is disposed to mesh with intermediate adjustment wheel 112 (a gear); intermediate adjustment wheel 112 meshes with date-adjusting wheel 113 (a gear); and date-adjusting wheel 113 meshes with controlled wheel 101.

With this configuration rotation of crown 80 is transferred by intervening first date-adjusting transfer wheel 110A and second date-adjusting transfer wheel 111 to date-adjusting wheel 113, and controlled wheel 101 is thereby rotationally driven. Turning controlled wheel 101 by turning crown 80 causes month wheel 103 and year wheel 105 to also turn. By turning the crown 80 forward and backward, the user can thus turn the date, month, and year displayed in the date window 204, month window 206, and year window 208, respectively, forward and backward. If the crown 80 of this wristwatch 1 is pulled to a second step and turned, the hour hand 63 and minute hand 62 turn as the crown 80 is turned.

Figure 6:
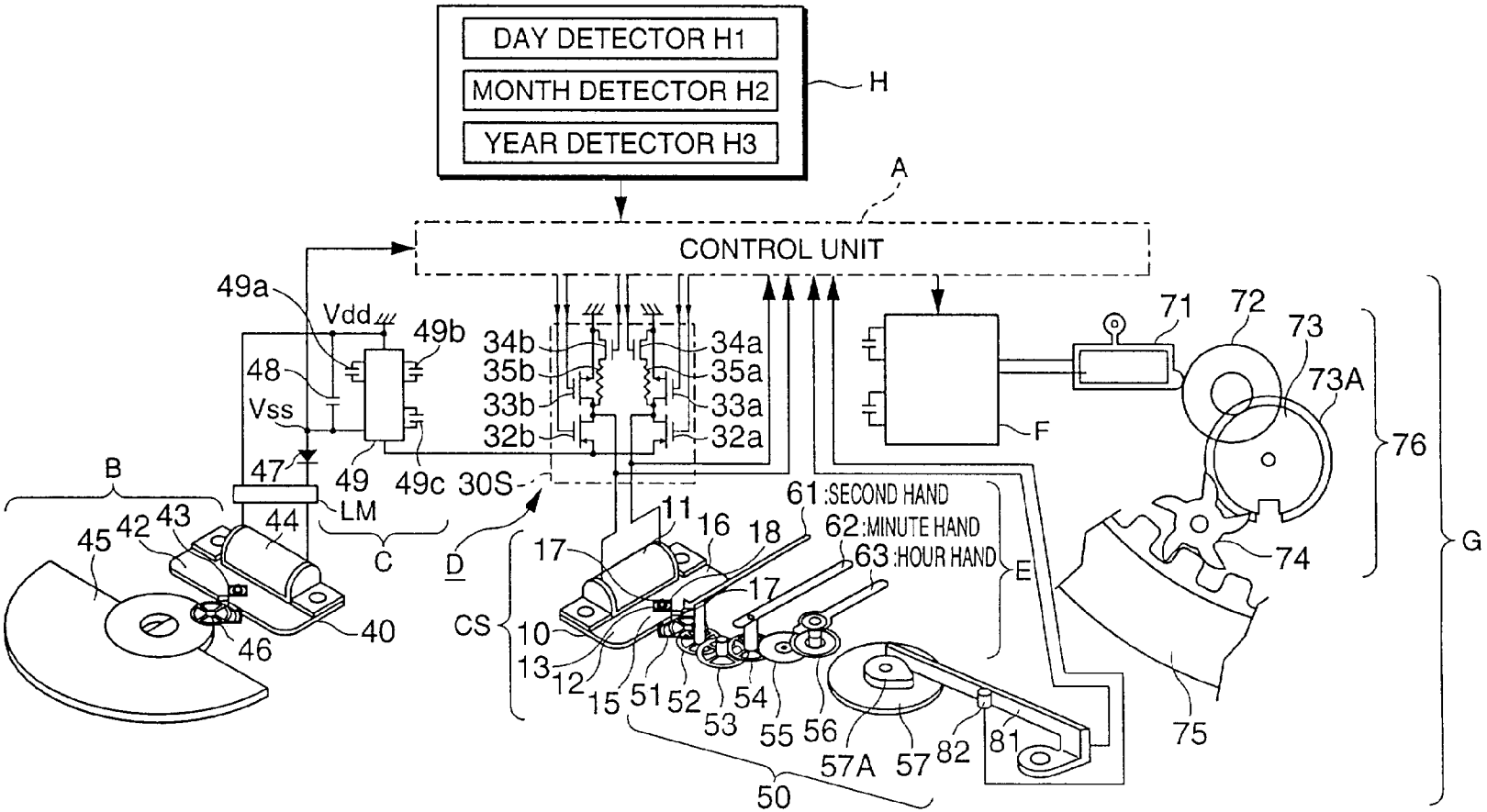
FIG. 6 is a schematic drawing showing the electrical configuration and mechanical configuration of the wristwatch.

FIG. 6 is a schematic drawing showing the electrical configuration and mechanical configuration of wristwatch 1. As shown in FIG. 6 the wristwatch 1 has eight major components, control unit A, power generating unit B, power supply C, hands driving unit D, movement E, calendar mechanism drive unit F, date display mechanism G, and displayed date detection unit H. Control unit A controls each part of the wristwatch 1.

Power generating unit B generates AC power and has a rotary pendulum 45. The rotary pendulum 45 is disposed so that it swings in conjunction with movement of the user's wrist, for example, and the swinging (kinetic energy) of the rotary pendulum 45 is transferred through acceleration wheel 46 to power generator 40. This power generator 40 has a power generation stator 42, a power generation rotor 43 disposed rotatably inside the power generation stator 42, and a power generation coil 44 electrically connected to the power generation rotor 43. When power generation rotor 43 is turned by the swinging (kinetic energy) of rotary pendulum 45, AC voltage is induced by the rotation in power generation coil 44. In other words, electrical power is generated by the swinging of rotary pendulum 45 as the user moves when wearing the wristwatch 1.

Power supply C rectifies and stores the ac voltage from power generating unit B, boosts the stored power, and supplies it to the other parts of the wristwatch 1. More specifically, power supply C has a diode 47 that operates as a rectifier circuit, a high capacity capacitor 48, and a voltage adjusting circuit 49. The voltage adjusting circuit 49 steps the voltage up or down in multiple stages using three capacitors 49*a*, 49*b*, 49*c* to adjust the voltage supplied to the hands driving unit D according to a control signal from the control unit A. The output voltage of the voltage adjusting circuit 49 is also supplied by a monitor signal to the control unit A, enabling the control unit A to monitor the output voltage. The power generating unit B takes Vdd (high voltage side) as the reference potential (GND), and produces Vss (low voltage side) as the supply voltage.

The hands driving unit D is controlled by control unit A and supplies different drive pulses to the movement E. More specifically, hands driving unit D has a bridge circuit composed of series connected p-channel MOS 33*a* and n-channel MOS 32*a*, and p-channel MOS 33*b* and n-channel MOS 32*b*; rotation detection resistors 35*a* and 35*b* parallel connected to p-channel MOS 33*a* and p-channel MOS 33*b*; and p-channel MOS 34*a* and 34*b* for sampling for providing a chopper pulse to resistors 35*a* and 35*b*. It is therefore possible to supply drive pulses such as drive pulses of different polarity to the movement E by applying control pulses of different polarity and pulse width from control unit A to the gates of MOS 32*a*, 32*b*, 33*a*, 33*b*, 34*a*, and 34*b* at specific timing.

The movement E has a stepping motor 10. The stepping motor 10 rotationally drives second hand 61, and as second hand 61 turns minute hand 62 and hour hand 63 are rotationally driven. More specifically, stepping motor 10 has a drive coil 11 that produces magnetic force from the drive pulse supplied from hands driving unit D, a stator 12 that is excited by the drive coil 11, and a rotor 13 that turns due to the magnetic field excited inside stator 12. The rotor 13 of this stepping motor 10 is a rotating permanent magnet consisting of a 2-pole, disc-shaped permanent magnet. The stator 12 has a magnetic saturation part 17 so that different magnetic poles are produced at each phase (pole) 15, 16 of the rotor 13 by the magnetic force produced by drive coil 11. An internal notch 18 is formed at an appropriate position at the inside circumference of stator 12 to restrict the direction of rotor 13 rotation, producing cogging torque so that rotor 13 stops at an appropriate position.

Rotation of stepping motor 10 rotor 13 is transferred to the hands through an intervening gear train 50 including fifth wheel 51 meshed with the rotor 13 pinion, fourth wheel 52, third wheel 53, second wheel 54, day wheel 55, center wheel 56, and 24-hour wheel 57. The second hand 61 is connected to the shaft of fourth wheel 52, minute hand 62 is connected to second wheel 54, and hour hand 63 is connected to center wheel 56. The time is displayed by the hands linked to rotation of rotor 13. In addition, 24-hour wheel 57 meshes with center wheel 56 and turns one revolution in 24 hours. When cam 57A disposed to 24-hour wheel 57 points the hour hand 63 to 0:00 (12:00 a.m.), switch shaft 81 [NOTE: 81 is stem 81 above] and switch pin 82 forming a normally-closed contact Sw separate and open to the off position. The control unit A can thus detect that the current time is 12:00 a.m.

The calendar mechanism drive unit F is also controlled by control unit A and drives date display mechanism G. More specifically, when control unit A detects that the current time is 12:00 a.m., it outputs an advance-day signal to the calendar mechanism drive unit F to rotationally drive day wheel 75 a one-day increment. When the calendar mechanism drive unit F receives the day-advance signal from control unit A, it applies ac voltage to the piezoelectric element of piezoelectric actuator 71, causing the piezoelectric actuator 71 to vibrate. As described above, vibration of the piezoelectric actuator 71 rotationally drives the day wheel 75 of date display mechanism G the distance equivalent to one day.

Figures 7, 8:
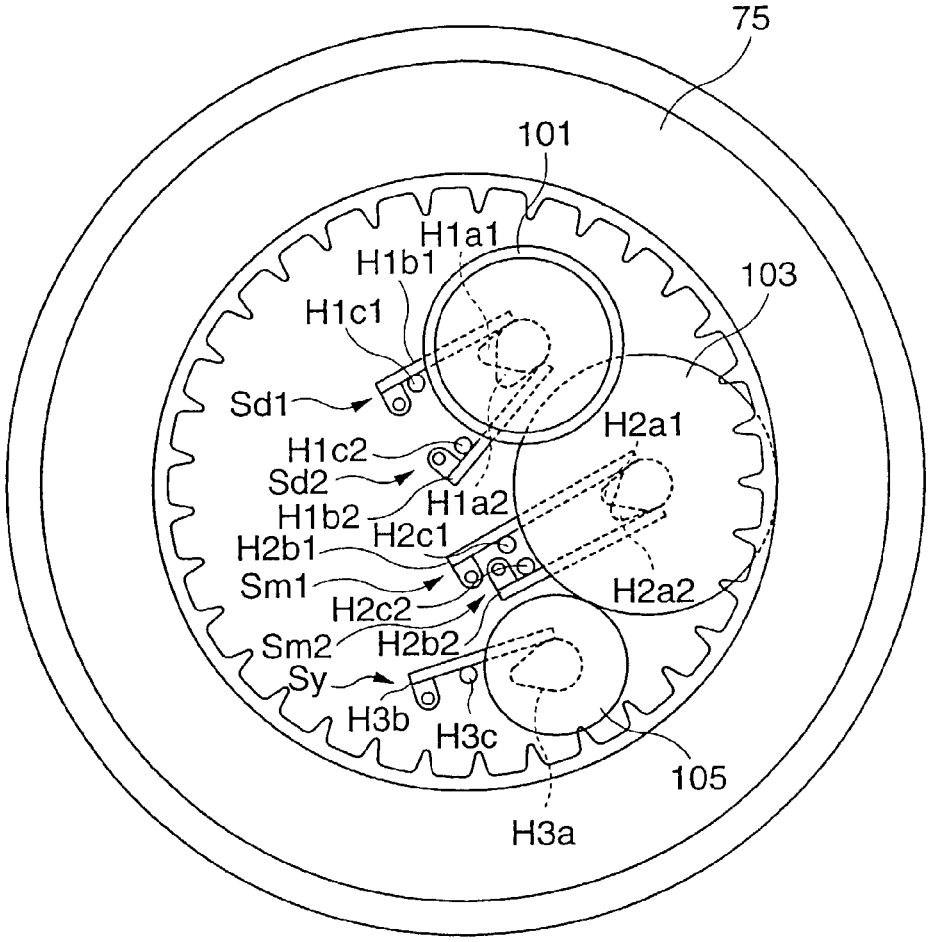
FIG. 7 is a schematic drawing of the mechanical configuration of the date detection unit.
FIG. 8 is a table showing the correlation between the displayed day and the open/closed states of normally-closed contacts disposed in the day detection unit to detect the day.

The date display detection unit H has a day detector H1 for detecting the day displayed in day window 204, a month detector H2 for detecting the month displayed in month window 206, and a year detector H3 for detecting the year displayed in year window 208. The day detector H1, month detector H2, and year detector H3 each have a configuration comparable to the normally-closed contact of the 24-hour wheel 57. That is, as shown in FIG. 7, day detector H1 has two control cams H1*a*1, H1*a*2 disposed to the bottom of controlled wheel 101, two control switch shafts H1*b*1, H1*b*2, and two control switch pins H1*c*1, H1*c*2. Control switch shaft H1*b*1 and control switch pin H1*c*1 form normally-closed contact Sd1. If either "29" or "30" on the top of day wheel 75 is displayed in day window 204, control cam H1*a*1 opens normally-closed contact Sd1.

Control switch shaft H1*b*2 and control switch pin H1*c*2 form normally-closed contact Sd2. If either "29" or "31" on the top of day wheel 75 is displayed in day window 204, control cam H1*a*2 opens normally-closed contact Sd2.

The control unit A can therefore detect whether 29, 30, 31, or a number from 1 to 28 is displayed in the day window 204 from the combination of the open and closed states of normally-closed contacts Sd1 and Sd2 in FIG. 8.

As also shown in FIG. 7, month detector H2 has two month wheel cams H2*a*1, H2*a*2 on the bottom of month wheel 103, two month wheel switch shafts H2*b*1, H2*b*2, and two month wheel switch pins H2*c*1, H2*c*2. Month wheel switch shaft H2*b*1 and month wheel switch pin H2*c*1 form normally-closed contact Sm1. If the letters corresponding to February on the surface of month wheel 103 are displayed in the month window 206, month wheel cam H2*a*1 opens normally-closed contact Sm1. Month wheel switch shaft H2*b*2 and month wheel switch pin H2*c*2 form normally-closed contact Sm2. If the letters for any of the short months other than February, that is, April, June, September, and November, on the surface of month wheel 103 are displayed in month window 206, month wheel cam H2*a*2 opens normally-closed contact Sm2.

The control unit A can therefore detect whether February, a long month, or a short month other than February is displayed in the month window 206 from the combination of the open and closed states of normally-closed contacts Sd1 and Sd2 in FIG. 9.

The year detector H3 has a year wheel cam H3*a* disposed to the bottom of year wheel 105, a year wheel switch shaft H3*b*, and a year wheel switch pin H3*c*. The year wheel switch shaft H3*b* and year wheel switch pin H3*c* form a normally-closed contact Sy. As shown in FIG. 10, if the Arabic numeral 0 on the surface of year wheel 105 is displayed in year window 208, that is, if it is a leap year, normally-closed contact Sy is opened by year wheel cam H3*a*. The control unit A can thus detect if a 0 denoting a leap year is displayed in the year window 208.

Figure 11:
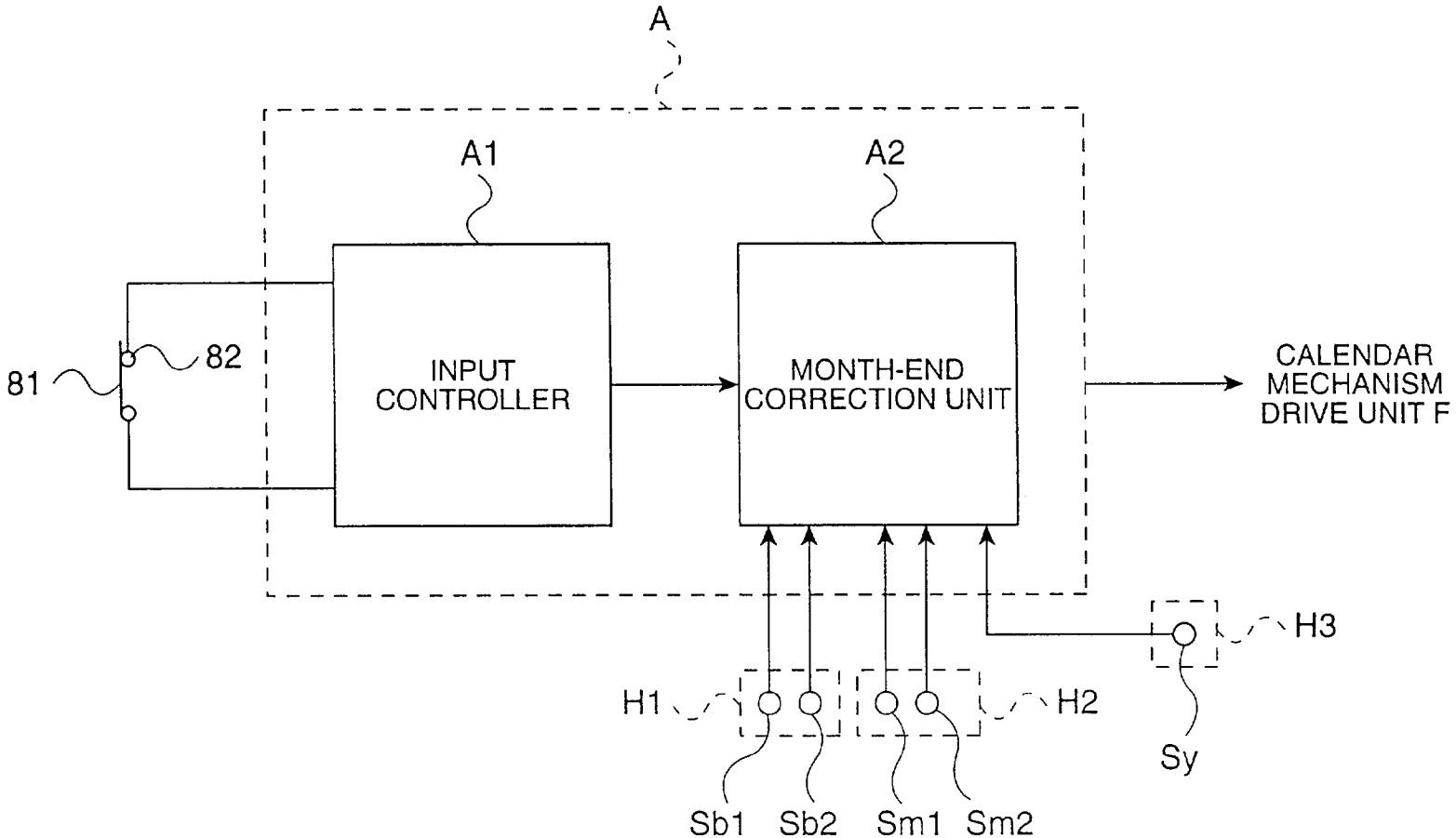
FIG. 11 is a block diagram showing the mechanical configuration of the control unit.

FIG. 11 is a function block diagram of control unit A. As shown in the figure control unit A has an input controller A1 and a month-end correction unit A2. The input controller A1 is electrically connected to the switch shaft 81 and switch pin 82 of movement E, and outputs a 0:00 detection signal to month-end correction unit A2 when the normally-closed contact Sw formed by switch shaft 81 and switch pin 82 is open (off).

When month-end correction unit A2 receives the 0:00 detection signal it outputs an advance-day signal to calendar mechanism drive unit F (see FIG. 6). The month-end correction unit A2 is also electrically connected to the normally-closed contacts Sd1, Sd2 of day detector H1, normally-closed contacts Sm1, Sm2 of month detector H2, and normally-closed contact Sy of year detector H3, and can determine from the combination of open and closed states of the normally-closed contacts whether the day displayed in day window 204 constitutes a non-existent date.

If month-end correction unit A2 determines that the day shown in day window 204 is a non-existent date, it outputs an advance-day signal to calendar mechanism drive unit F to drive the piezoelectric actuator 71 so that a valid day is displayed in day window 204.

Thus comprised, if the month-end correction unit A2 of control unit A detects from the open/closed states of the normally-closed contacts Sd1, Sd2 in displayed date detection unit H that the day shown in the day window 204 is the 29th or 30th as a result of calendar mechanism drive unit F rotationally driving day wheel 75, it can determine whether or not the day displayed in day window 204 constitutes a non-existent date. If the month-end correction unit A2 thus detects that a non-existent date is displayed, it runs a month-end correction process to output an advance-day signal to calendar mechanism drive unit F so that the actual day is shown in the day window 204.

Figure 12:
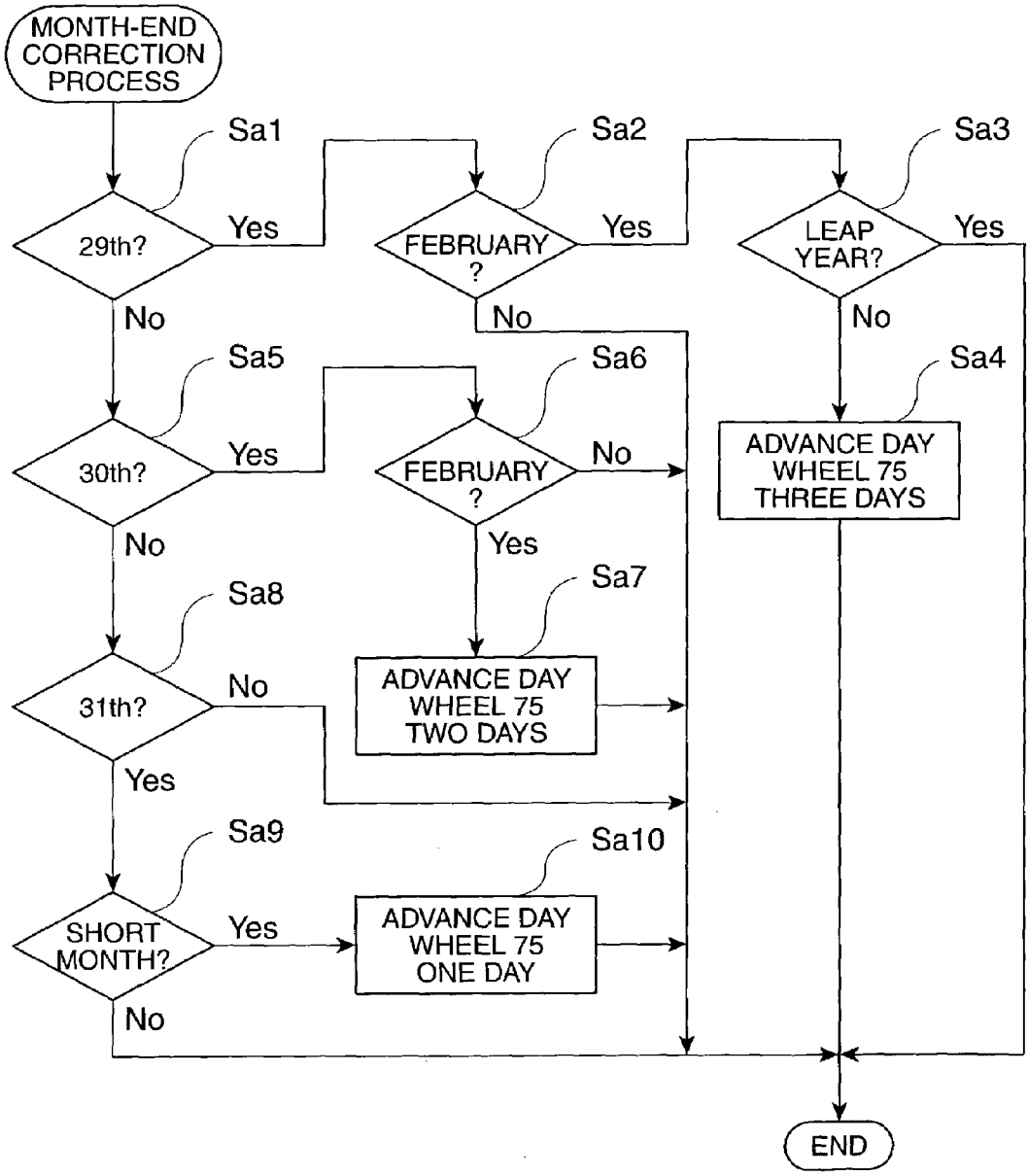
FIG. 12 is a flow chart of a month-end correction process run by the month-end correction unit.

FIG. 12 is a flow chart of an exemplary month-end correction process run by the month-end correction unit A2. As shown in FIG. 12, if the displayed date is February 29, month-end correction unit A2 first determines if the date is valid or not by determining if the current year is a leap year. More specifically, month-end correction unit A2 determines if the day displayed in day window 204 is "29" by detecting if both normally-closed contacts Sd1, Sd2 are open (step Sa1). If step Sa1 returns yes, month-end correction unit A2 determines whether the displayed month is February (i.e., "FEB" is displayed in month window 206) by detecting if normally-closed contact Sm1 is open and normally-closed contact Sm2 is closed (step Sa2). If FEB is displayed (step Sa2 returns yes), month-end correction unit A2 determines if the current year is a leap year by determining if normally-closed contact Sy is open. If step Sa3 returns yes, then February 29 is a valid date and month-end correction unit A2 ends the month-end correction process.

If step Sa3 returns no, however, February 29 is an invalid (non-existent) date and the actual date is March 1.

In order to display "MAR 1" month-end correction unit A2 outputs an advance-day signal to the calendar mechanism drive unit F to advance day wheel 75 three days (step Sa4), and the month-end correction process ends.

If step Sa2 returns no, the displayed date is the 29th of some month other than February and is therefore valid, and the month-end correction unit A2 thus ends the month-end correction process.

If the displayed day is "30", month-end correction unit A2 determines if the displayed date is "February 30."

More specifically, if step Sa1 returns no, month-end correction unit A2 detects if normally-closed contact Sd1 is open and normally-closed contact Sd2 is closed to determine if "30" is shown as the day in day window 204 (step Sa5). If step Sa5 returns yes, month-end correction unit A2 determines if FEB is shown as the month in month window 206 in the same way as in step Sa2 (step Sa6). If the result is yes, the displayed date is February 30 and is thus invalid (a non-existent date).

Therefore, in order to display "MAR 1" month-end correction unit A2 outputs an advance-day signal to the calendar mechanism drive unit F to advance day wheel 75 two days (step Sa7), and the month-end correction process ends.

However, if step Sa6 returns no, the displayed date is the 30th of some month other than February and is therefore valid, and the month-end correction unit A2 thus ends the month-end correction process.

If step Sa5 returns no, the month-end correction unit A2 performs the following steps so that the 31st of a short month (e.g., April 31) is not displayed.

The month-end correction unit A2 determines if "31" is shown as the day in day window 204 by detecting if normally-closed contact Sd1 is closed and normally-closed contact Sd2 is open (step Sa8). If the result is yes, month-end correction unit A2 detects if a short month other than February (that is, April, June, September, or November) is displayed in month window 206 by detecting if normally-closed contact Sm1 is closed and normally-closed contact Sm2 is open (step Sa9). If the result is yes, the 31st of a short month is displayed, the date is invalid (non-existent), and the actual date is the first of the next month. Month-end correction unit A2 therefore outputs an advance-day signal to the calendar mechanism drive unit F to advance day wheel 75 one day (step Sa10), and the month-end correction process ends.

If step Sa8 returns no, the day displayed in the day window 204 is from "1" to "28" and is therefore valid (exists) in every month, and the month-end correction unit A2 therefore ends the month-end correction process.

If step Sa9 returns no, the displayed date is the 31st of a long month (January, March, May, July, August, October, or December), and is therefore valid (exists), and month-end correction unit A2 thus ends the month-end correction process.

The month-end correction unit A2 of a wristwatch 1 according to this embodiment of the invention thus determines if the displayed date exists from the calendar information displayed in date window 204, month window 206, and year window 208. If the month-end correction unit A2 determines that the displayed date does not exist (is invalid), it controls the calendar mechanism drive unit F to display a valid date.

Therefore, if for some reason the date displayed on the wristwatch 1 does not match the actual date and the user turns the crown 80 to reset the displayed date to the current date, the date will thereafter be automatically displayed correctly according to the calendar without an invalid date being left displayed. In other words, a perpetual calendar mechanism is achieved.

When the user corrects the calendar information stored in the IC device of a conventional electronic timepiece, a piezoelectric actuator rotationally drives the day wheel to display a date corresponding to the corrected calendar information. If the date is greatly adjusted, the day wheel must be driven to turn far, and much power is consumed by the piezoelectric actuator 71. If the piezoelectric actuator 71 rotationally drives the day wheel 75 in conjunction with adjusting the date, a voltage drop that causes the electronic timepiece to stop could occur.

With a wristwatch 1 according to the present invention, however, the user can adjust the date displayed in the respective windows to the current actual date by simply turning the crown 80. It is therefore unnecessary to drive the piezoelectric actuator 71 in order to adjust the date, and power consumption by the piezoelectric actuator 71 can be significantly reduced.

A further problem with an electronic timepiece according to the prior art is that if the day displayed in the day window is offset much from the actual date, the piezoelectric actuator must rotationally drive the day wheel a corresponding distance to adjust the date, and it takes awhile until the actual date is displayed.

A wristwatch 1 according to the present invention, however, does not need to drive the piezoelectric actuator 71 to adjust the date, and these problems thus do not occur.

Conventional portable electronic timepieces generally display only the day and do not display the month or year. The user must infer the date from the displayed day information and the user's self-provided knowledge of the current month and year. This is because in order to maintain the portability of the electronic timepiece, a high capacity (that is, physically large) battery cannot be used. More specifically, if the year and month are also displayed even more power is consumed by the piezoelectric actuator to adjust the month and year when setting the date. A high capacity battery must therefore be used but such a high capacity battery cannot be installed because of the size restrictions of the electronic timepiece (wristwatch).

As described above, however, wristwatch 1 according to the present invention does not need to drive the piezoelectric actuator 71 in order to set the date. Power is therefore not consumed by a piezoelectric actuator in order to set the date even if the day, month, and year are all displayed, and a high capacity battery is therefore not needed.

Furthermore, in order to adjust the calendar information in an electronic timepiece according to the prior art the user first manipulates the crown or other operator to set the day displayed in the day window to a specific reference date (such as January 1 of a leap year), then applies a calendar information initialization command to the IC in order to set the stored calendar information to the displayed date (that is, reset it to a reference position). The user then sets the current date as the displayed date.

A sequence of steps is thus required, and this operation is complicated for the user.

With a wristwatch 1 according to the present invention, however, the user simply turns the crown 80 to set the date displayed in each of the windows to the current date. It is not necessary to first reset the date to some reference position, and adjusting the date is therefore easier and faster.

A counter for storing calendar information relating to the year, month, and date in an IC device is also not needed with a timepiece according to the present invention. The IC design is therefore simplified and the circuit scale of the IC device can be further reduced. The device can therefore be made smaller and manufacturing costs can be reduced.

Furthermore, the present invention provides a month window 206 and year window 208 in addition to day window 204 to display the date rather than also displaying the month with a day hand and time hands (hour, minute, and second hands) as in a prior art timepiece. The user can therefore read the date easily without performing any special operation, and can also easily adjust the date.

A perpetual calendar function is generally considered achieved if the last day of each month is correctly adjusted even though the last day of February is not correctly displayed in leap years (that is, the date is not correctly displayed as February 29).

The present invention can therefore also be achieved if the parts relating to displaying the year, that is, year wheel 105 and parts for driving the year wheel 105, are omitted. In this case the month-end correction unit A2 does not need to detect leap years.

Alternative Embodiments

It will be obvious to one skilled in the art that the preferred embodiment described above can be varied in many ways without departing from the scope of this invention. Some of these variations are described below.

Variation 1

The invention is described in the preceding embodiment as a wristwatch, but the invention shall not be so limited and could be a pocketwatch or other type of portable timepiece.

The invention shall also not be limited to portable timepieces, and could be applied to a wall clock, mantel clock, or other type of stationary timepiece.

Whether portable or stationary, the present invention can also be applied to timepieces that electronically adjust the time by receiving a radio signal indicating a standard time (such as JJY signal transmissions).

Variation 2

A wristwatch 1 that displays the calendar month and year in separate windows is described above. The invention shall not be so limited, however, and the year wheel 105 and month wheel 103 could be combined into a single disc-shaped year-month wheel so that the month and year are displayed in the same window.

Figure 13:
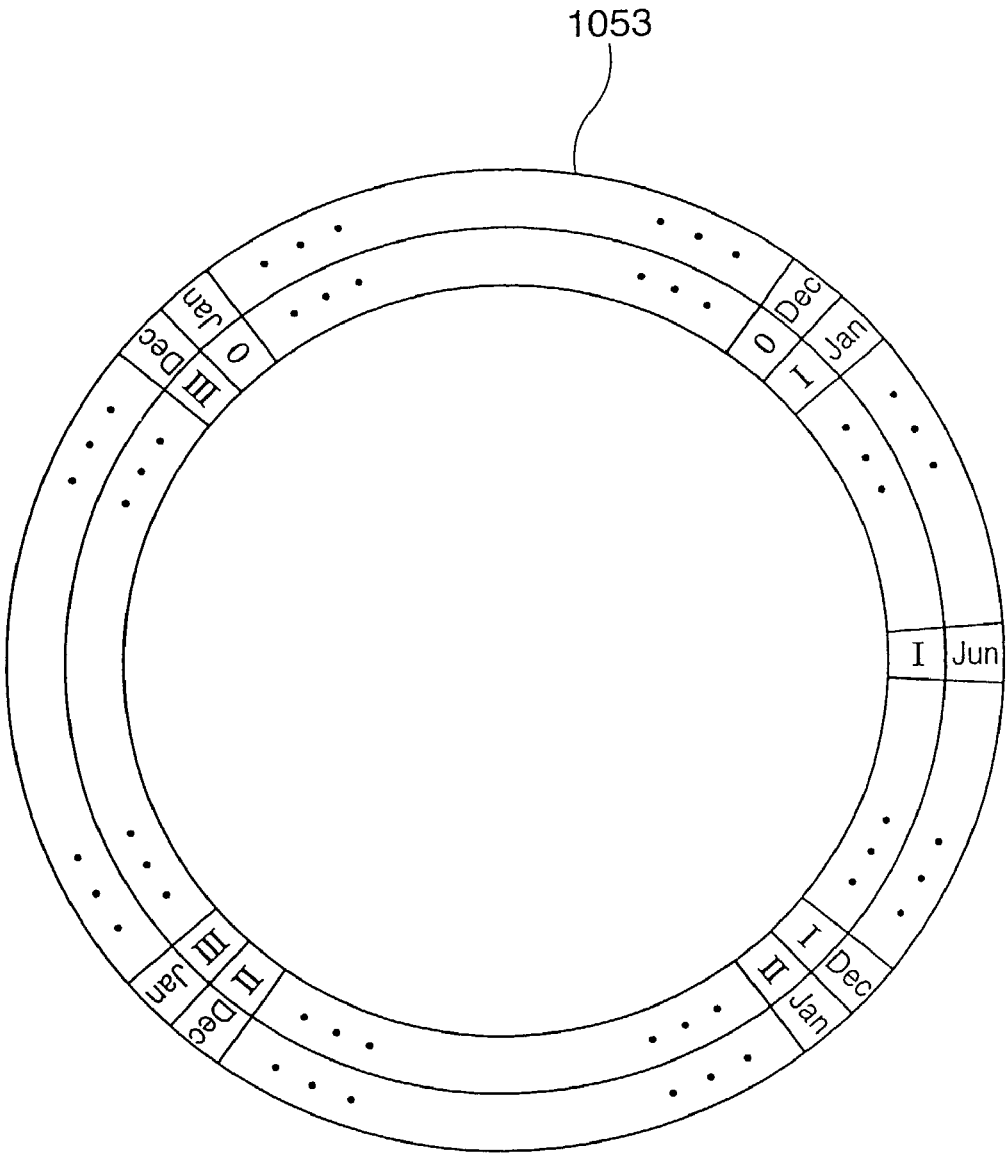
FIG. 13 shows the configuration of a year-month wheel according to a second embodiment of the invention.

More specifically, as shown in FIG. 13, the year wheel 105 and month wheel 103 can be replaced with a year-month wheel 1053 having the twelve months for a four year period disposed at equal intervals around the circumference. This configuration simplifies the configuration of the timepiece and enables reducing the size of the watch.

Figure 14:
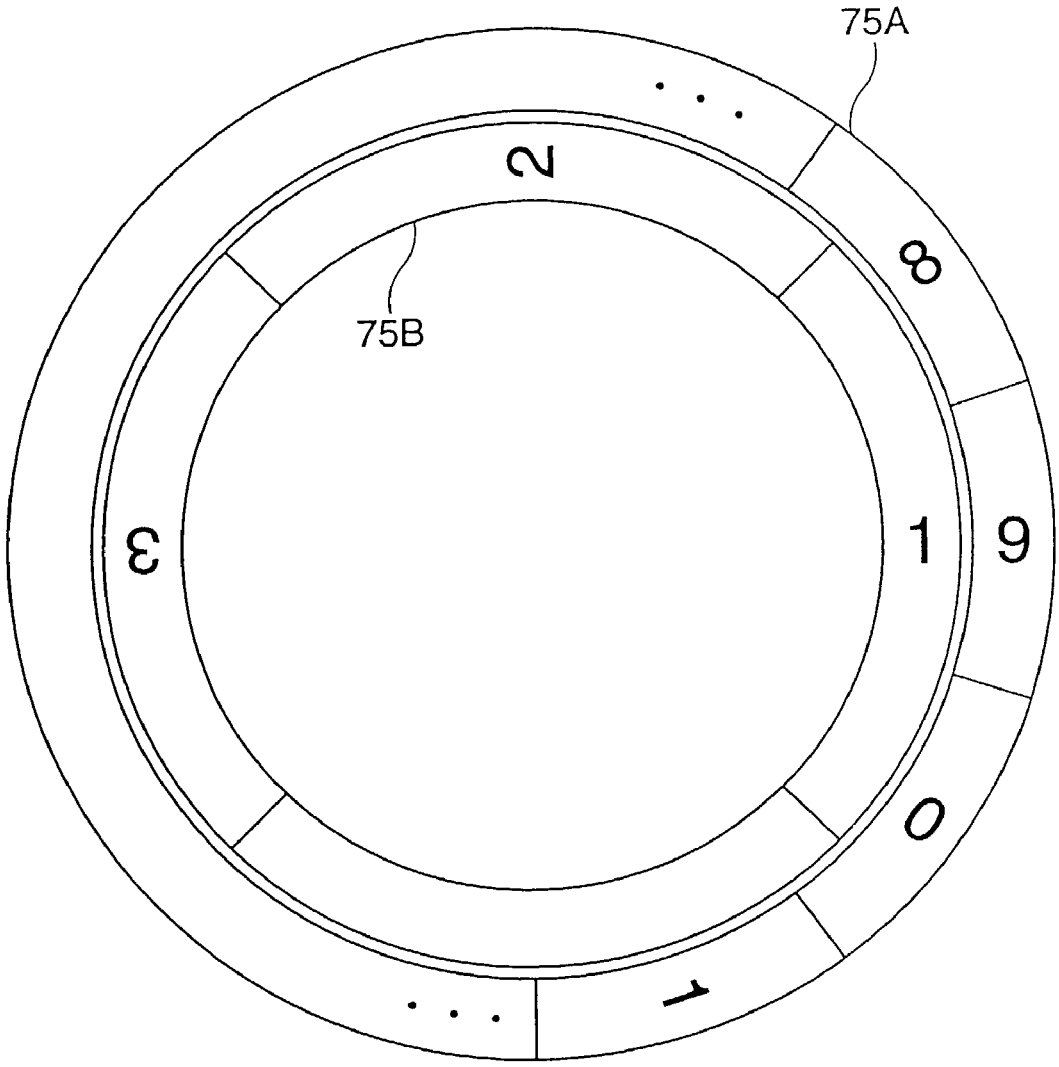
FIG. 14 shows a ones-column day wheel and a tens-column date wheel in another variation of the present invention.

The day wheel 75 is also described above having the numbers "1" to "31". As shown in FIG. 14, the date could alternatively be displayed using a first order day wheel 75A for displaying the numbers 0 to 9 in the first digit of the date, and a second order day wheel 75B for displaying the numbers 1 to 3 corresponding to the second digit of the date.

Furthermore, the above embodiment displays the year by indicating the number of years passed since the previous leap year, but the absolute year value of the Gregorian calendar, for example, could obviously be alternatively displayed.

Variation 3

Normally-closed contacts are used in the above embodiment to detect the date values displayed in day window 204, month window 206, and year window 208, but the invention shall not be so limited. For example, the value displayed by the day wheel 75, month wheel 103, and year wheel 105 could be detected using contactless sensors such as photodetectors or magnetic sensors.

Variation 4

A piezoelectric actuator 71 is used as the actuator for rotationally driving the day wheel 75 in the above embodiment, but an ultrasonic motor, electromagnetic motor, or other type of actuator could be used. Furthermore, a configuration using only one piezoelectric actuator 71 to rotationally drive day wheel 75 is described in the above embodiment, but the invention shall not be so limited. A separate piezoelectric actuator could be provided for month wheel 103 and year wheel 105, for example, so that the day wheel 75, month wheel 103, and year wheel 105 are independently driven. In this case the day wheel 75 or month wheel 103 is preferably rotationally driven according to the direction of crown 80 rotation. For example, if the crown 80 turns one way the day wheel 75 turns, and if the crown 80 turns the other way the month wheel 103 turns.

Variation 5

A rotary pendulum 45 is provided in power generating unit B in the preceding embodiment to generate power from the swinging (kinetic energy) of the rotary pendulum 45. The power generating unit B could be alternatively designed, however, to generate power using natural energy such as by solar power generation or thermoelectric generation.

The above embodiment is also designed to supply power from an internal power generator to the other parts of wristwatch 1, but could be configured with a primary cell instead of a power generator.

Variation 6

The above embodiment also described by way of example a configuration in which the date is displayed by showing letters, numbers, or symbols on a flat day wheel 75, month wheel 103, and year wheel 105 through respective windows. Alternatively, the invention could be configured to display the date with hands instead of such disc-shaped members. In this case letters or symbols representing the date are also provided on the dial 202 in addition to symbols for indicating the time.

Furthermore, the date is displayed with the day, month, and year in the above embodiment, but it is also possible to display only the day and not display the month and year.

Variation 7

In the first embodiment month-end correction unit A2 runs a month-end correction process for detecting whether "29", "30" or "31" is shown in the day window 204 as a result of calendar mechanism drive unit F rotationally driving day wheel 75 according to an advance-day signal.

Figure 15:
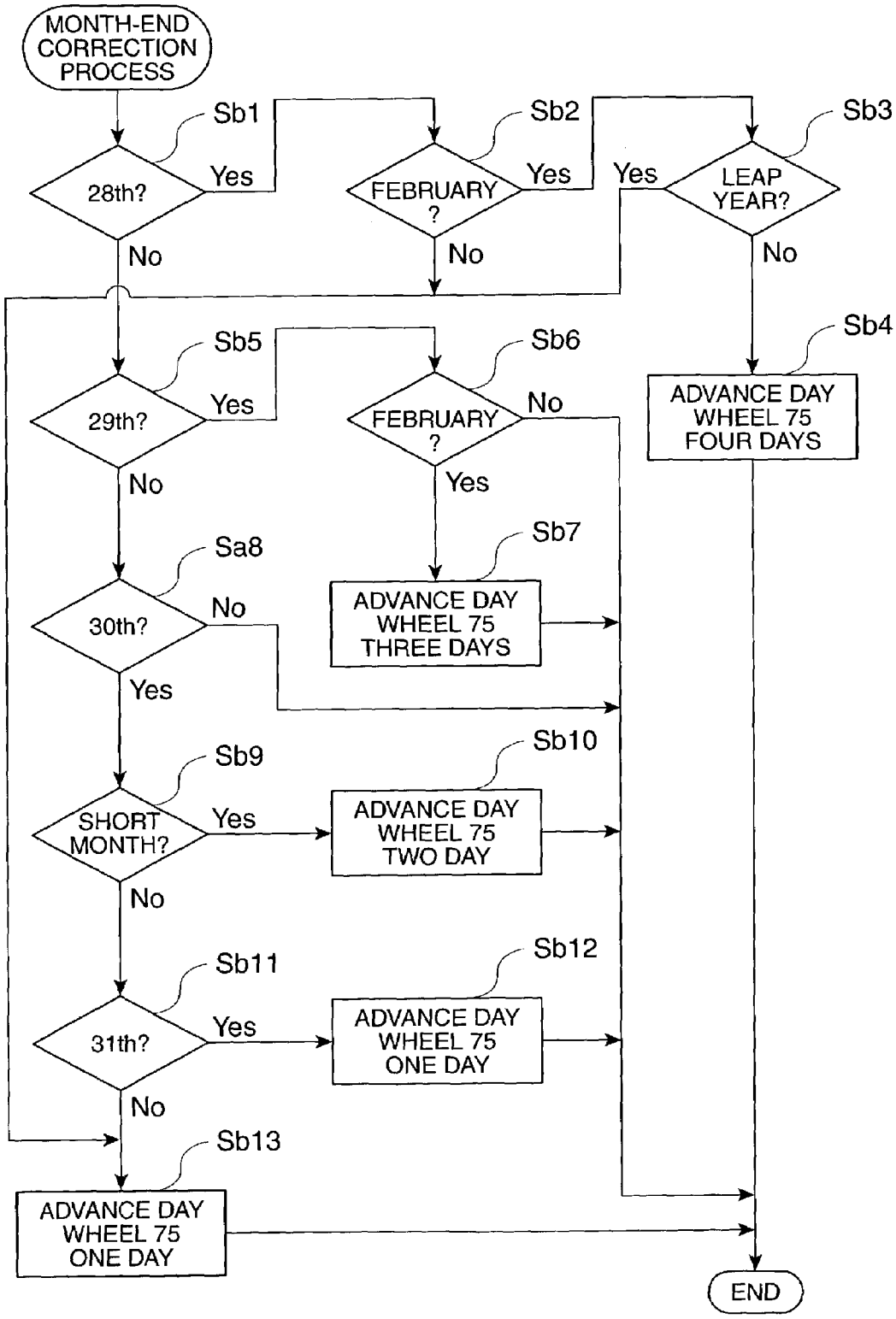
FIG. 15 is a flow chart of a month-end correction process according to a seventh embodiment of the invention.

An alternative month-end correction process could be used as shown in FIG. 15, however. In this process month-end correction unit A2 detects whether "28" to "30" is displayed in the day window 204 to detect the date of the next day, and then controls calendar mechanism drive unit F to rotationally drive day wheel 75 to display tomorrow's date.

More specifically, when month-end correction unit A2 detects the 0:00 detection signal it detects the open/closed state of normally-closed contacts Sd1, Sd2 in day detector H1 to determine the day displayed in day window 204. Depending on the detected day it knows the date of the next day, and then outputs an advance-day signal to calendar mechanism drive unit F to display the next date.

Variation 8

A configuration for detecting the day values displayed in day window 204, month window 206, and year window 208 is described by way of example in the above embodiment. Alternatively, the control unit A could have counters for separately counting the month and year. In this case displayed date detection unit H detects only the day shown in day window 204. This design simplifies the configuration of the day detector H1.

[Effect of the Invention]

The present invention thus provides an electronic timepiece with a date display function that enables the user to adjust the date easily while reducing power consumption in conjunction with date adjustments by the user.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece with a date display function, comprising:

a power supply;

an actuator driven by the power supply;

a day display means for displaying a calendar day, wherein the day display means is driven by the actuator during a normal date display mode and is driven by a user-manipulatable manual operator during a calendar-correction mode;

a month display means driven by the day display means for displaying a calendar month;

a year display means driven by the day display means for displaying a calendar year;

a date detecting means for detecting the day displayed by the day display means, the month displayed by the month display means, and the year displayed by the year displaying means; and a control means for determining from the detected day, month, and year if the day displayed by the day display means is a non-existent date on a calendar year, and, if the displayed date is a non-existent date, then controlling the actuator to drive the day display means until an existing date is displayed.

2. An electronic timepiece with a date display function as described in claim 1, wherein the day display means comprises:

a drive means for driving said actuator, said drive means being powered by said power supply;

a first order display wheel that is a flat member having, positioned on a surface thereof, numerals or symbols denoting numerals 0 to 9, and is driven by the actuator that is driven by the drive means, said first order display wheel being further disposed to enable being driven by manipulation of the manual operator, for displaying the unit of the first order of a calendar day as driven; and a second order display wheel that is a flat member having, positioned on a surface thereof, numerals or symbols denoting numerals 0 to 3 for displaying the unit of the second order of the calendar day according to first order display wheel drive.

3. An electronic timepiece with a date display function, comprising:

a power supply;

an actuator driven by the power supply;

a day display means for displaying a calendar day, wherein the day display means is driven by the actuator during a normal date display mode and is driven by a user-manipulatable operator during a calendar correction mode;

a year-month display means driven by the day display means for displaying a number of years since a previous leap year and a calendar month;

a date detecting means for detecting the day displayed by the day display means, the number of years since a previous leap year, and the calendar month displayed by the year-month displaying means; and a control means for determining from the detected day, years since a previous leap year, and month if the day displayed by the day display means is a non-existent date on a calendar, and if the displayed date is a non-existent date then controlling the actuator to drive the day display means until an existing date is displayed.

4. An electronic timepiece with a date display function, comprising:

a power supply;

an actuator driven by the power supply;

a day displayer for displaying a calendar day, wherein the day displayer is driven by the actuator during a normal date display mode and is driven by a user-manipulatable manual operator during a calendar-correction operation;

a month displayer driven by the day displayer for displaying a calendar month;

a year displayer driven by the day displayer for displaying a calendar year;

a date detector for detecting the day displayed by the day displayer, the month displayed by the month displayer; and the year displayed by the year displayer and a controller for determining from the detected day, month, and year if the day displayed by the day displayer is a non-existent date on a calendar year, and, if the displayed date is a non-existent date, then controlling the actuator to drive the day displayer until an existing date is displayed.

5. An electronic timepiece with a date display function as described in claim 4, wherein the day displayer includes:

a driver for driving said actuator, said driver being powered by said power supply;

a first order display wheel that is a flat member having, positioned on a surface thereof, numerals or symbols denoting numerals 0 to 9, and is driven by the actuator that is driven by the driver, said first order display wheel being further disposed to enable being driven by manipulation of the manual operator, for displaying the unit of the first order of a calendar day as driven; and a second order display wheel that is a flat member having, positioned on a surface thereof, numerals or symbols denoting numerals 0 to 3 for displaying the unit of the second order of the calendar day according to first order display wheel drive.

6. An electronic timepiece with a date display function, comprising:

a power supply;

an actuator driven by the power supply;

a day displayer for displaying a calendar day, wherein the day displayer is driven by the actuator during a normal date display operation and is driven by a user-manipulatable operator during a calendar-correction mode;

a year-month displayer driven by the day displayer for displaying a number of years since a previous leap year and a calendar month;

a date detector for detecting the day displayed by the day displayer, the number of years since a previous leap year, and the calendar month displayed by the year-month displayer; and a controller for determining from the detected day, years since a previous leap year, and month if the day displayed by the day displayer is a non-existent date on a calendar, and if the displayed date is a non-existent date then controlling the actuator to drive the day displayer until an existing date is displayed.

7. A method of implementing a date display function in an electronic timepiece, said method comprising:

providing a power supply;

providing an actuator driven by the power supply;

providing a day displayer for displaying a calendar day, permitting the day displayer to be optionally driven by the actuator during a normal date display mode and by a user-manipulatable manual operator during a calendar-correction mode;

providing a month displayer driven by the day displayer for displaying a calendar month;

providing a year displayer driven by the day displayer for displaying a calendar year;

detecting the day displayed by the day displayer, the month displayed by the month indicator, and the year displayed by the year displayer; and determining from the detected day, month, and year if the day displayed by the day displayer is a non-existent date on a calendar year, and, if the displayed date is a non-existent date, then controlling the actuator to drive the day displayer until an existing date is displayed.

8. The method of claim 7, wherein the step of providing a day displayer includes:

providing a driver for driving said actuator, said driver being powered by said power supply;

providing a first order display wheel that is a flat member having, positioned on a surface thereof, numerals or symbols denoting numerals 0 to 9, and is driven by the actuator that is driven by the driver, said first order display wheel being further disposed to enable being driven by manipulation of the manual operator, for displaying the unit of the first order of a calendar day as driven; and providing a second order display wheel that is a flat member having, positioned on a surface thereof, numerals or symbols denoting numerals 0 to 3 for displaying the unit of the second order of the calendar day according to first order display wheel drive.

9. A method of implementing a date display function in an electronic timepiece, said method comprising:

providing a power supply;

providing an actuator driving by the power supply;

providing a day displayer for displaying a calendar day, permitting the day displayer to be optionally driven by the actuator during a normal date display operation and by a user-manipulatable operator during a calendar-correction mode;

providing a year-month displayer driven by the day displayer for displaying a number of years since a previous leap year and a calendar month;

detecting the day displayed by the day displayer, the number of years since a previous leap year, and the calendar month displayed by the year-month displayer; and determining from the detected day, years since a previous leap year, and month if the day displayed by the day displayer is a non-existent date on a calendar, and if the displayed date is a non-existent date then controlling the actuator to drive the day displayer until an existing date is displayed.

* * * * *